US007694953B2

(12) United States Patent
Hiramitsu et al.

(10) Patent No.: US 7,694,953 B2
(45) Date of Patent: Apr. 13, 2010

(54) SHEETS PROCESSING APPARATUS

(75) Inventors: Naruaki Hiramitsu, Kanagawa-ken (JP); Kazuya Saimei, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 381 days.

(21) Appl. No.: 10/968,272

(22) Filed: Oct. 20, 2004

(65) Prior Publication Data

US 2005/0098938 A1 May 12, 2005

(30) Foreign Application Priority Data

Nov. 6, 2003 (JP) ..... 2003-377312

(51) Int. Cl.
*B65H 29/66* (2006.01)

(52) U.S. Cl. ..... 271/65; 271/186

(58) Field of Classification Search ..... 271/65, 271/185, 186, 291, 301
See application file for complete search history.

(56) References Cited

U.S. PATENT DOCUMENTS

| | | | | |
|---|---|---|---|---|
| 5,449,166 | A | 9/1995 | Lohmann et al. | |
| 6,726,198 | B2 * | 4/2004 | Glemser et al. | 271/65 |
| 6,726,199 | B2 | 4/2004 | Ina et al. | |
| 6,782,236 | B2 | 8/2004 | Sasaki et al. | |
| 7,108,260 | B2 * | 9/2006 | Biegelsen et al. | 271/303 |
| 7,201,370 | B2 * | 4/2007 | Hiramitsu | 271/186 |
| 7,306,219 | B2 * | 12/2007 | Keil et al. | 271/225 |
| 2002/0165075 | A1 * | 11/2002 | Shea et al. | 492/56 |
| 2003/0102624 | A1 | 6/2003 | Stoll | |

FOREIGN PATENT DOCUMENTS

| | | |
|---|---|---|
| JP | 57-165642 U | 10/1982 |
| JP | 58-11806 Y2 | 3/1983 |
| JP | 60-241977 | 11/1985 |
| JP | 07-002409 | 1/1995 |
| JP | 07-051632 | 2/1995 |
| JP | 2003-104611 | 4/2003 |
| JP | 2003-104612 | 4/2003 |

OTHER PUBLICATIONS

Japanese Office Action dated Jun. 24, 2008 for Appln. No. 2003-377312A.

* cited by examiner

*Primary Examiner*—Patrick H Mackey
*Assistant Examiner*—Michael C McCullough
(74) *Attorney, Agent, or Firm*—Pillsbury Winthrop Shaw Pittman, LLP

(57) ABSTRACT

A sheets processing apparatus includes a first processing portion having a first switchback portion for reversing the conveying direction of postal matter branched and conveyed from a main conveying path and a first U-turn path for reversing the front and back of the postal matter and a second processing portion having a second U-turn path for reversing the front and back of the postal matter branched and conveyed from the main conveying path and a second switchback portion for reversing the conveying direction of the postal matter. The first switchback portion is arranged inside the second U-turn path and the second switchback portion is arranged inside the first U-turn path.

4 Claims, 6 Drawing Sheets

SHEETS PROCESSING APPARATUS

CROSS-REFERENCE TO RELATED APPLICATIONS

This application is based upon and claims the benefit of priority from prior Japanese Patent Application No. 2003-377312, filed Nov. 6, 2003, the entire contents of all of which are incorporated herein by reference.

BACKGROUND OF THE INVENTION

1. Field of the Invention

The present invention relates to a sheets processing apparatus for reversing the front and back of each paper-like material and reversing the conveying direction thereof.

2. Description of the Related Art

Conventionally, as a sheets processing apparatus for reversing the front and back of each paper-like material and reversing the conveying direction thereof, for example, as disclosed in U.S. Pat. No. 6,726,199 (Apr. 27, 2004), a switchback device equipped with a switchback portion respectively on both sides of the conveying path is known.

The switchback device repeats an operation of receiving a paper-like material conveyed via the conveying path by one switchback portion, reversing the conveying direction, sending it out onto the conveying path, receiving another paper-like material by the other switchback portion, reversing the conveying path, and sending it out onto the conveying path, thereby continuously switches back a plurality of paper-like materials continuously conveyed.

However, the switchback device is designed so as to process paper-like materials which are comparatively thin and soft such as banknotes and are not suited to paper-like materials such as postal mattes which are comparatively thick and hard like letters. Namely, the switchback device suddenly bends the conveying direction of a paper-like material conveyed via the conveying path, leads it to the switchback portion installed in the direction almost perpendicular to the conveying path, when ejecting it from the switchback portion to the conveying path, suddenly bends the paper-like material, and ejects it to the conveying path, so that it cannot process normally thick and hard paper-like materials.

If it is intended to process a thick and hard paper-like material such as a postal matter by the switchback device, the device must be made larger to increase the curvature of the part for bending the conveying direction of the paper-like material, thus a problem arises that the device must be made larger.

SUMMARY OF THE INVENTION

An object of the present invention is to provide a sheets processing apparatus capable of processing comparatively thick and hard paper-like materials and realizing miniaturization.

According to an aspect of the present invention, a sheets processing apparatus is provided, which comprises a main conveying path configured to convey a first and second sheets to be processed; a first processing portion having a first switchback portion configured to receive the first sheet branched and conveyed from the main conveying path, send the first sheet out in an opposite direction, thereby reversing the conveying direction of the first sheet and a first U-turn path configured to pass the first sheet switched back by the first switchback portion; a second processing portion having a second U-turn path, which is installed alongside of the first processing portion and along the main conveying path, configured to pass the second sheet branched and conveyed from the main conveying path and a second switchback portion configured to receive the second sheet passing the second U-turn path, send the second sheet out in an opposite direction, thereby reversing the conveying direction of the second sheet; and a conveying path to an exit configured to join and convey the first sheet from the first processing portion and the second sheet from the second processing portion.

BRIEF DESCRIPTION OF THE DRAWINGS

The exact nature of the present invention, as well as other objects and advantages thereof, will be readily apparent from consideration of the following specification relating to an annexed drawing in which.

DETAILED DESCRIPTION OF THE INVENTION

The embodiments of the present invention will be explained in detail bellow with reference to the accompanying drawings.

Figure 1A:
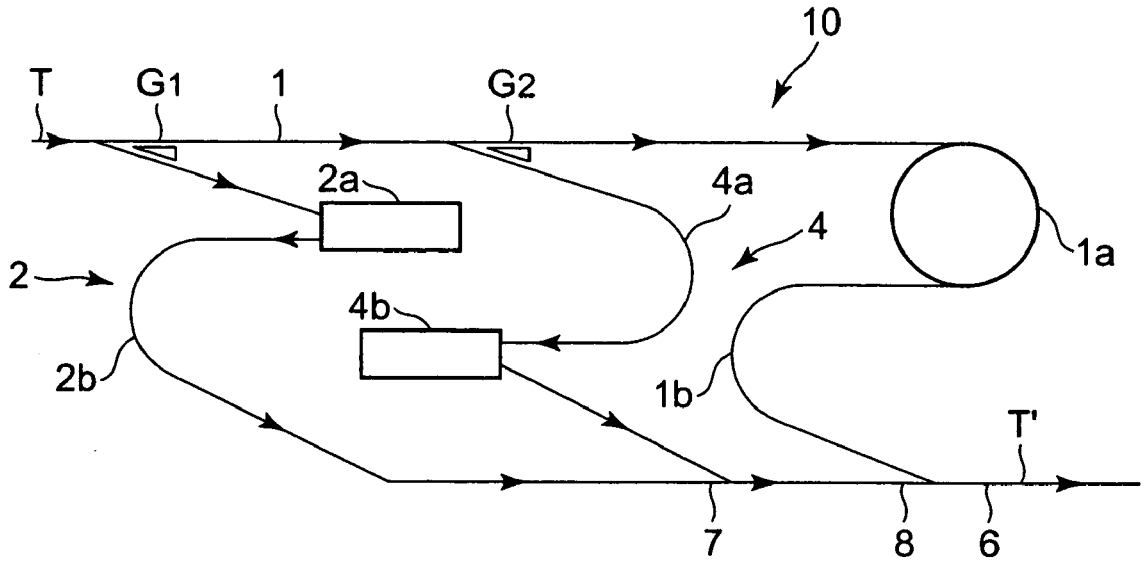
FIG. 1A is a plan view showing the schematic structure of the sheets processing apparatus relating to the first embodiment of the present invention.

FIG. 1A shows a plan view showing the schematic structure of sheets processing apparatus 10 (hereinafter, just referred to as processing apparatus 10) relating to the first embodiment of the present invention. Here, processing apparatus 10 for processing postal matter M such as a letter as a comparatively thick and hard paper-like material will be explained, though media to be handled are not limited to it. Further, processing apparatus 10 functions so as to detect stamps put on all postal matter M beforehand and to arrange the front and back and the top and bottom of postal matter M so that the stamps are positioned in the same direction.

Processing apparatus 10 has main conveying path 1 for conveying postal matter M to be processed in the direction of arrow T shown in the drawing. On the upstream side of main conveying path 1 in the conveying direction that is not shown in the drawing, a detector not shown in the drawing is installed and the stamps of all postal matter M are detected and sent. On one side of main conveying path 1 (the lower side in FIG. 1A), first processing portion 2 and second processing portion 4 are installed side by side in conveying direction T. Further, on main conveying path 1, switching gates G1 and G2 for branching and conveying postal matter M conveyed via main conveying path 1 respectively to first processing portion 2 and second processing portion 4 are installed.

First processing portion 2 has first switchback portion 2*a* for receiving postal matter M branched and conveyed from main conveying path 1 via gate G1, sending them out in the opposite direction, thereby reversing the conveying direction of postal matter M and first U-turn path 2*b* for passing postal matter M switched back by first switchback portion 2*a* and reversing the front and back thereof. Namely, postal matter M branched and conveyed to first processing portion 2 is switched back first, is reversed in the conveying direction, then is reversed in the front and back, and finally is, reversed in the top and bottom and the front and back. And, postal matter M passing first processing portion 2, via conveying path 6 to an exit extending almost in parallel with main conveying path 1 under first and second processing portions 2 and 4 shown in the drawing, is conveyed to a processing portion at the latter stage, which is not shown in the drawing, in the direction of arrow T' shown in the drawing.

Second processing portion 4 has second U-turn path 4*a* for passing postal matter M branched and conveyed from main conveying path 1 via gate G2 and reversing the front and back thereof and second switchback portion 4*b* for receiving postal matter M reversed in the front and back by second U-turn path 4*a*, sending it out in the opposite direction, thereby reversing the conveying direction thereof. Namely, postal matter M branched and conveyed to second processing portion 4 is reversed in the front and back first, then is switched back, is reversed in the conveying direction, and finally is reversed in the front and back and the top and bottom. And, postal matter 4 passing second processing portion 4 is led to conveying path 6 to an exit via joining portion 7 and is conveyed to a processing portion at the latter stage which is not shown in the drawing.

Further, first and second switchback portions 2*a* and 2*b* reverse postal matter M to be conveyed so as to true up all the front ends thereof at the head in the conveying direction.

Namely, when postal matter M is conveyed on main conveying path 1 with the front ends thereof positioned at the head, it advances toward drum roller 1*a* as it is without passing first processing portion 2 and second processing portion 4.

On the other hand, when postal matter M is conveyed on main conveying path 1 with the rear ends thereof positioned at the head, postal matter M passes first processing portion 2 or second processing portion 4 via gate G1 or G2 and to reverse postal matter M so as to position the front ends thereof at the head, passes first switchback portion 2*a* or second switchback portion 4*b*.

Further, main conveying path 1 is located on the downstream side of two gates G1 and G2 in the conveying direction and is connected to conveying path 6 to an exit on the downstream side of joining portion 7 in the conveying direction. Main conveying path 1 on the upstream side of joining portion 8 is curved via drum roller 1*a* and U-turn path 1*b*. And, postal matter M passing gates G1 and G2 and then passing first and second processing portions 2 and 4, without being reversed in the front and back and the top and bottom, is conveyed to a processing portion at the latter stage, which is not shown in the drawing, via main conveying path 1 and conveying path 6 to an exit. Further, the length of each conveying path mentioned above and the processing time in each of first and second switchback portions 2*a* and 4*b* are designed so that all postal matter M sent to processing apparatus 10 via main conveying path 1 is conveyed to the joining portion on conveying path 6 to an exit in the same time.

Figure 2:
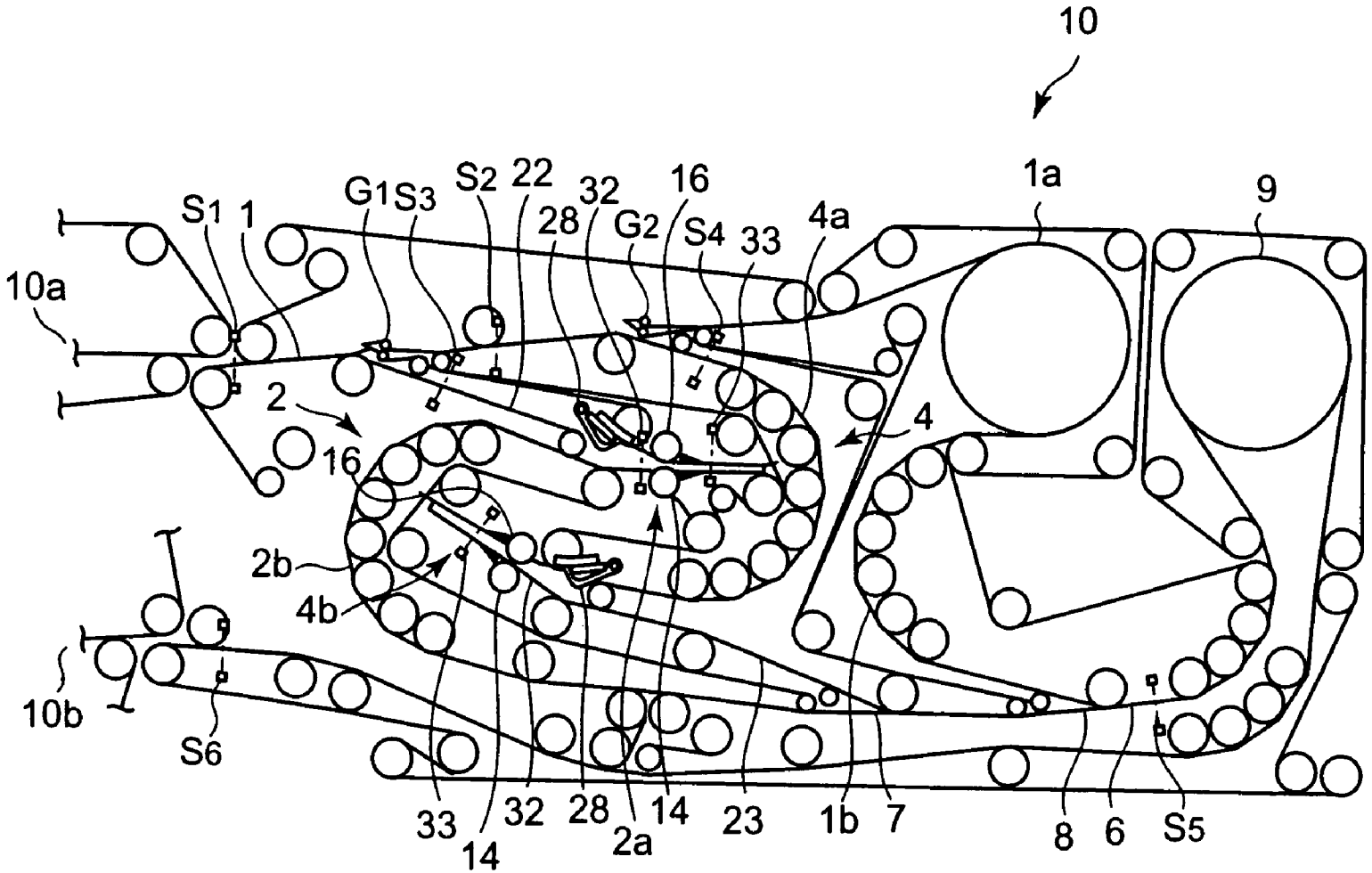
FIG. 2 is a plan view showing the detailed structure of the sheets processing apparatus shown in FIG. 1.

FIG. 2 shows a plan view showing the detailed structure of processing apparatus 10. However, the structure of processing apparatus 10 is not limited to the structure shown in FIG. 2.

Figure 1B:
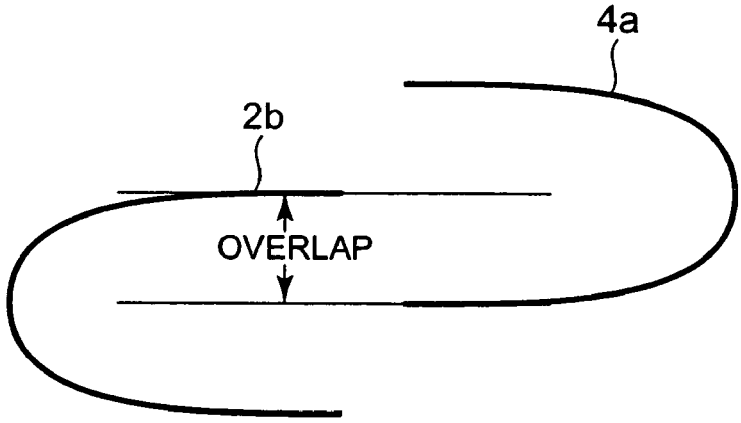
FIG. 1B is a schematic plan view showing the arrangement state of the first U-turn path and second U-turn path of the sheets processing apparatus shown in FIG. 1A.

According to the structure, first switchback portion 2*a* of first processing portion 2 is arranged inside second U-turn path 4*a* of second processing portion 4 in a nest shape and second switchback portion 4*b* of second processing portion 4 is arranged inside first U-turn path 2*b* of first processing portion 2 in a nest shape. In other words, in processing apparatus 10 mentioned above, FIG. 1B shows that first switchback portion 2*a* and second switchback portion 4*b* are arranged so as to be overlapped with each other in the direction separating from main conveying path 1, that is, in the direction almost perpendicular to the direction in which first processing portion 2 and second processing portion 4 are lined up and first U-turn path 2*b* and second U-turn path 4*a* are arranged so as to be overlapped with each other in the direction separating from main conveying path 1.

Namely, like processing apparatus 10 of the first embodiment mentioned above, a structure that one processing portion switches back postal matter M and then reverses the front and back thereof and the other processing portion reverses the front and back of postal matter M and then switches back it is adopted, thus the size of the apparatus in the direction in which first and second processing portions 2 and 4 are lined up can be reduced and the apparatus constitution can be miniaturized. Particularly, like processing apparatus 10 mentioned above, when a structure that inside the U-turn path of one processing portion, the switchback portion of the other processing portion is arranged in a nest shape is adopted, the size of the apparatus can be miniaturized effectively.

Further, in processing apparatus 10 of this embodiment, conveying path 6 to an exit winds round drum roller 9 on the downstream side of joining portion 8 in the conveying direction to make a U-turn and supply portion 10*a* and discharge portion 10*b* of postal matter M to processing apparatus 10 are located on the left of apparatus 10 in the drawing. Further, processing apparatus 10 has a plurality of sensors for detecting passing of postal matter M on the conveying paths. Namely, on main conveying path 1 on the upstream side of gate G1 in the conveying direction, sensor S1 is arranged, and on main conveying path 1 between gates G1 and G2, sensor S2 is arranged, and on the conveying path branched by gate G1 toward first processing portion 2, sensor S3 is arranged, and on the conveying path branched by gate G2 toward second processing portion 4, sensor S4 is arranged, and on conveying path 6 to an exit, sensor S5 is arranged, and in the neighborhood of discharge portion 10*b* of postal matter M, sensor S6 is arranged.

Figure 3A:
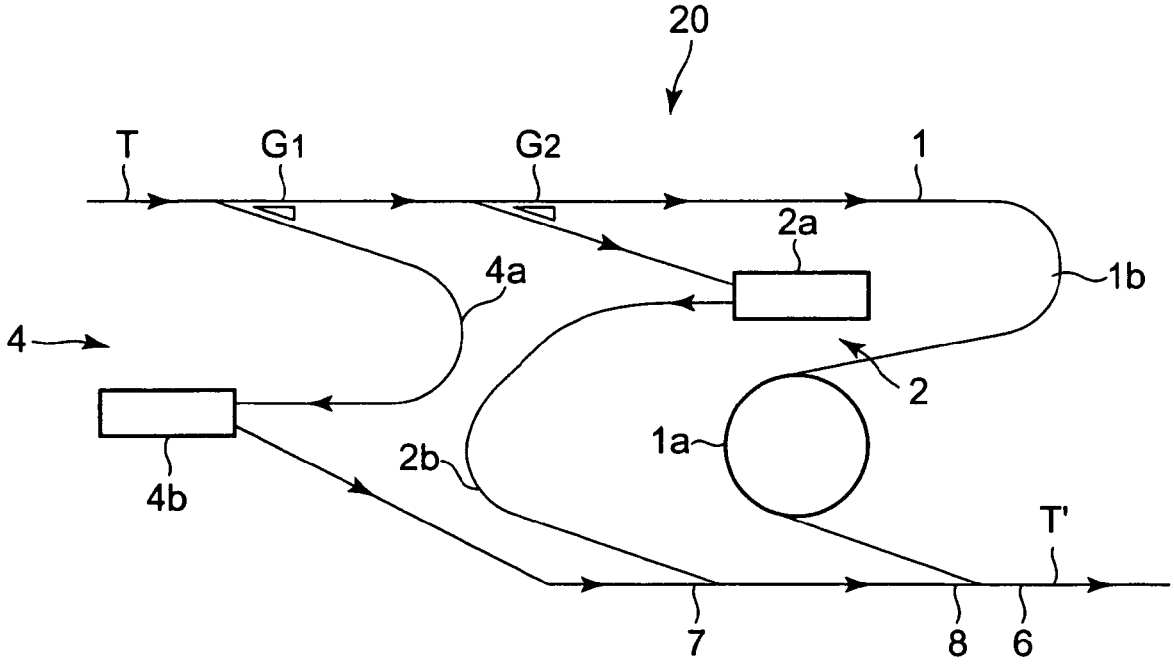
FIG. 3A is a plan view showing the schematic structure of the sheets processing apparatus relating to the second embodiment of the present invention.

FIG. 3A shows a plan view of the schematic structure of sheets processing apparatus 20 relating to the second embodiment of the present invention. Processing apparatus 20 has the same structure as that of processing apparatus 10 of the first embodiment mentioned above except that first processing portion 2 and second processing portion 4 are mounted inversely and drum roller 1*a* and U-turn path 1*b* are mounted inversely.

Figure 3B:
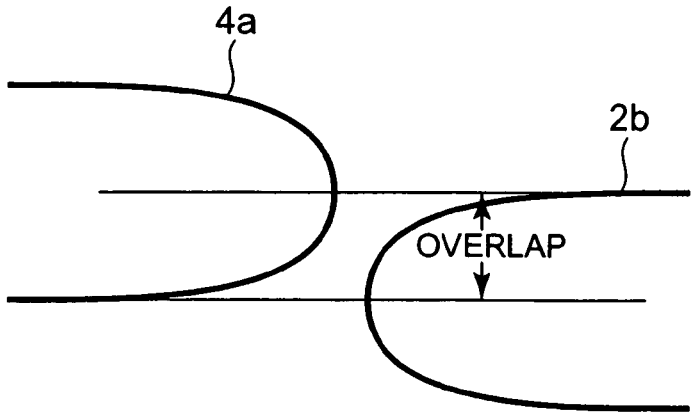
FIG. 3B is a schematic plan view showing the arrangement state of the first U-turn path and second U-turn path of the sheets processing apparatus shown in FIG. 3A.

Namely, in processing apparatus 20, as shown in FIG. 3B, first U-turn path 2*b* and second U-turn path 4*a* are overlapped with each other in the direction separating from main conveying path 1 and the apparatus size along main conveying path 1 is reduced. Further, processing apparatus 10 has a structure that first switchback portion 2*a* of first processing portion 2 installed along main conveying path 1 on the downstream side in the conveying direction is arranged inside U-turn path 1*b* of main conveying path 1 and furthermore, the apparatus size is reduced.

Hereinafter, the aforementioned switchback portions will be explained in detail by referring to FIGS. 4 to 7.

Figure 4:
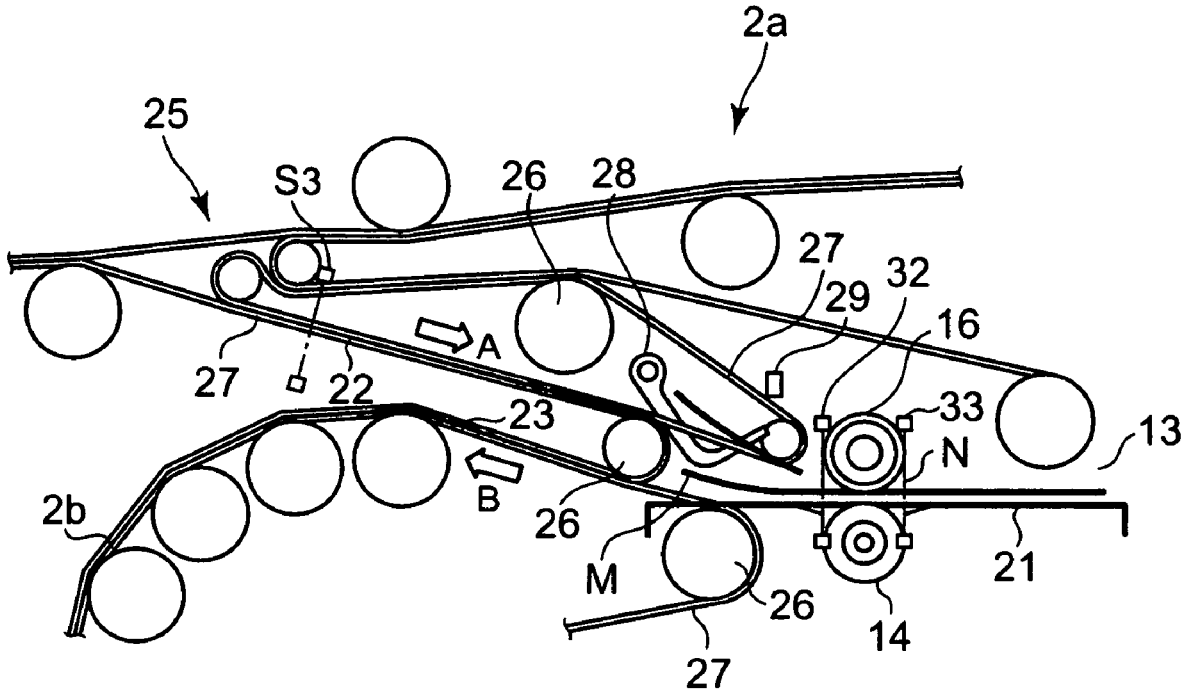
FIG. 4 is a plan view showing the enlarged switchback portion incorporated in the sheets processing apparatus shown in FIG. 1.
Figure 5:
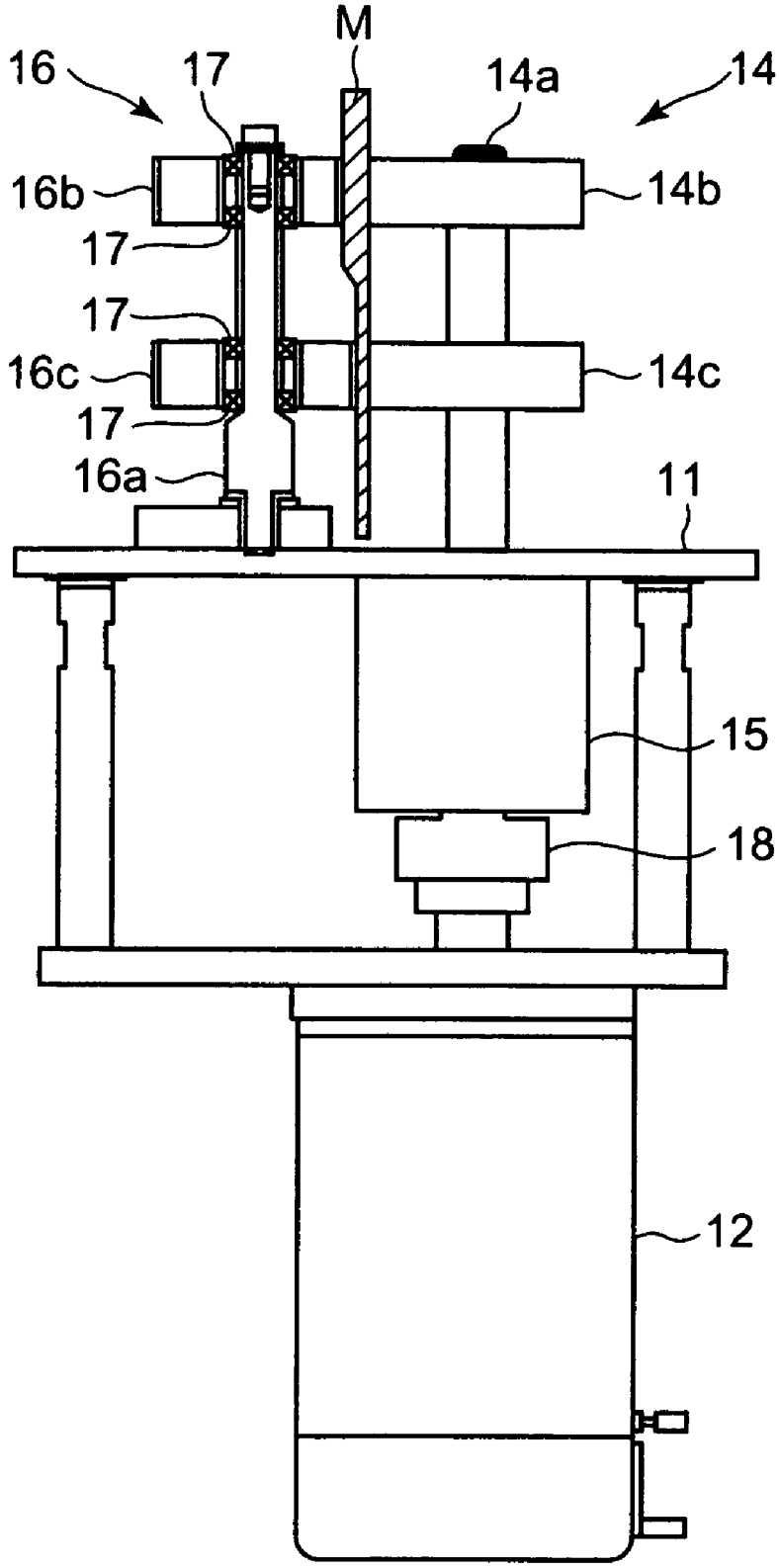
FIG. 5 is a side view of the switchback portion shown in FIG. 4 viewed in the receiving direction of a paper-like material.

FIG. 4 shows a plan view of the detailed structure of first switchback portion 2*a* mentioned above. Further, FIG. 5 shows a side view of switchback portion 2*a* viewed in the sending direction of postal matter M (the direction of arrow A shown in FIG. 4).

Further, second switchback portion 4*b* has a structure that first switchback portion 2*a* is reversed horizontally, so that here, first switchback portion 2*a* will be explained representatively and the explanation of second switchback portion 4*b* will be omitted.

First switchback portion 2*a* (hereinafter, just referred to as switchback portion 2*a*) has drive roller 14 rotating forward and backward by motor 12 (FIG. 5) and driven roller 16. Rollers 14 and 16 are mutually pressed via conveying path 13. Further, switchback portion 2*a* has guide plate 21 extending along the lower surface side of conveying path 13 via nip N between two rollers 14 and 16.

Drive roller 14 has rotation shaft 14*a* extending almost vertically and two roller portions 14*b* and 14*c*. Two roller portions 14*b* and 14*c* are vertically separated from each other along rotation shaft 14*a* and are fixed to rotation shaft 14*a*. The base end of rotation shaft 14*a* is attached to frame 11 of processing apparatus 10 rotatably and fixedly. Namely, to frame 11, housing 15 with a plurality of bearings not shown in the drawing incorporated is fixed and rotation shaft 14*a* is extended through the housing. Further, the base end of rotation shaft 14*a* extending through housing 15 is directly connected to the rotation shaft of motor 12.

On the other hand, driven roller 16 has rotation shaft 16*a* fixed to frame 11. Rotation shaft 16*a* does not rotate to frame 11. On rotation shaft 16*a*, two roller portions 16*b* and 16*c* (described later) formed by an elastically deformable material are installed axially away from each other and are independently attached rotatably to rotation shaft 16*a*. Namely, two roller portions 16*b* and 16*c* are respectively attached to rotation shaft 16*a* via two bearings 17. Further, two roller portions 16*b* and 16*c* are positioned respectively so as to roll and touch two roller portions 14*b* and 14*c* mentioned above.

The inter-shaft distance of drive roller 14 and driven roller 16 is set so that roller portions 14*b* and 16*b* and roller portions 14*c* and 16*c* are pressed via conveying path 13. Namely, rotation shafts 14*a* and 16*a* of two rollers 14 and 16 are respectively attached to frame 11 in a fixed position relationship, so that roller portions 16*b* and 16*c* of driven roller 16 are elastically deformed as shown in the drawing, thus pressure is generated between the two. Further, roller portions 16*b* and 16*c* of driven roller 16 are elastically deformed, thus postal matter M is permitted to pass.

Further, switchback portion 2*a* has carry-in conveying path 22 for sending postal matter M toward nip N in the direction of arrow A shown in the drawing and discharge conveying path 23 for sending postal matter M in the opposite direction to nip N, that is, in the direction of arrow B shown in the drawing. Namely, switchback portion 2*a* has conveying mechanism 25 for conveying postal matter M in the direction of arrow A via carry-in conveying path 22 and conveying postal matter M in the direction of arrow B via discharge conveying path 23. Conveying mechanism 25 has a plurality of conveying rollers 26 and a plurality of endless conveying belts 27 which are wound round conveying rollers and are stretched.

Further, on carry-in conveying path 22, aforementioned sensor S3 for detecting passing of postal matter M is installed. Sensor S3 is installed to detect, on the basis of the time from passing of the front end of postal matter M in the conveying direction to passing of the rear end thereof in the conveying direction, the length of postal matter M in the conveying direction. Namely, sensor S3 is installed to obtain the deceleration, stop, and acceleration timing of drive roller 14.

Furthermore, before and after nip N, sensors 32 and 33 are respectively installed. Two sensors 32 and 33 are installed to detect the existence of postal matter M at nip N.

Switchback portion 2*a* having the aforementioned structure operates as indicated below.

When postal matter M is sent in the direction of arrow A by conveying mechanism 25 via carry-in conveying path 22, passing of postal matter M is detected by sensor S3, and the length of postal matter M in the conveying direction is detected, and the front end of postal matter M in the conveying direction rushes into nip N between drive roller 14 and driven roller 16. At this time, drive roller 14 rotates clockwise and driven roller 16 is driven to roll counterclockwise. When postal matter M passes nip N, roller portions 16*b* and 16*c* of driven roller 16 are elastically deformed and follow postal matter M.

And, postal matter M rushes into nip N, and then drive roller 14 is decelerated at a predetermined timing, and postal matter M is stopped. This state is shown in FIG. 4. Hereafter, lever 28 is rotated to the posture shown in FIG. 4 by a driving mechanism not shown in the drawing and hits stopped postal matter M on the left end thereof shown in the drawing. Hereafter, lever 28 returns to its home position (not shown in the drawing) by sensor 29. By doing this, the end is directed downward and gets for the reverse operation.

Hereafter, drive roller 14 is reversed and postal matter M clamped, bound, and stopped by nip N is accelerated in the direction of arrow B, is transferred to conveying mechanism 25, and is discharged via discharge conveying path 23. By doing this, the conveying direction of postal matter M is reversed.

Figure 6:
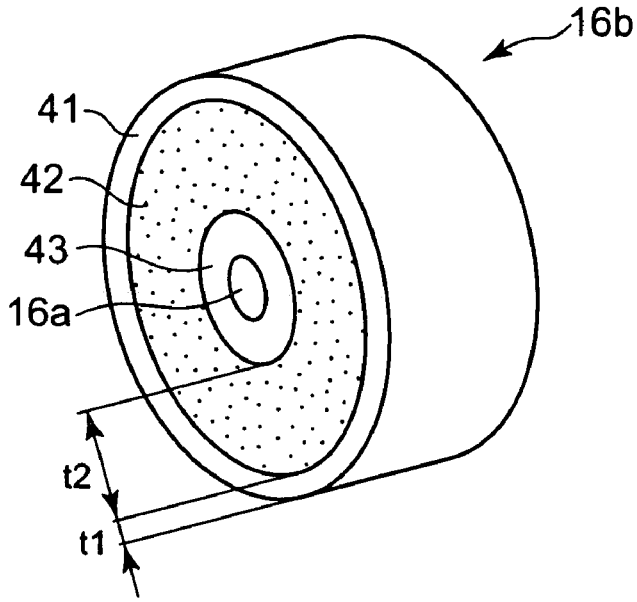
FIG. 6 is a perspective view for explaining the structure of a roller portion of a driven roller incorporated in the switchback portion shown in FIG. 4.

Hereinafter, by referring to FIG. 6, roller portion 16*b* of driven roller 16 will be explained more in detail. Further, roller portion 16*c* has the exactly same structure as that of roller portion 16*b*, so that roller portion 16*b* will be explained representatively.

Roller portion 16*b* has an elastically deformable two-layer structure that an outer first layer in contact with roller portion 14*b* of drive roller 14 is formed by rubber 41 (a solid elastic body) and an inner second layer is formed by sponge 42 (a foamed elastic body). In this embodiment, outside rotation shaft 16*a*, aluminum core metal 43 is installed via a bearing not shown in the drawing, and sponge 42 is installed outside core metal 43, and outside sponge 42, rubber 41 is installed. Further, the thickness t1 of rubber 41 is set to 2 [mm], and the thickness t2 of sponge 42 is set to 13 [mm], and the diameter of core metal 43 is set to 20 [mm], and the diameter of roller portion 16*b* is set to 50 [mm]. Further, the width of roller portion 16*b* is set to 15 [mm]. Further, roller portions 14*b* and 14*c* of drive roller 14 are also formed by the same rubber material as rubber 41 of roller portions 16*b* and 16*c* of driven roller 16.

As described above, driven roller 16 is fixedly arranged in the state that it is pressed against drive roller 14, so that when postal matter M rushes into nip N, driven roller 16 will not jump up from conveying path 13. Namely, at this time, driven roller 16 is deformed as shown in FIG. 5 according to the thickness of postal matter M and clamps and conveys postal matter M passing nip N by always giving pressure to it.

Therefore, the conveying force by drive roller 14 is effectively transferred to postal matter M and the conveying speed of postal matter M is prevented from changing.

Figure 7:
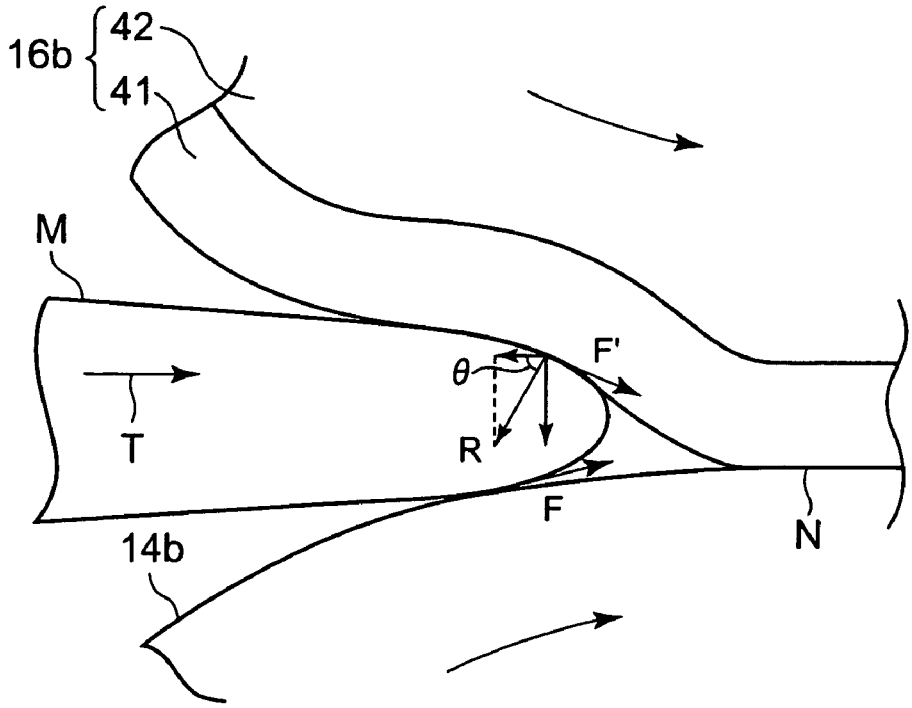
FIG. 7 is a drawing for explaining the behavior when a paper-like material rushes between the drive roller and the driven roller.

Next, by referring to FIG. 7, the behavior of driven roller 16 (roller portion 16*b*) and postal matter M when postal matter M rushes into nip N will be considered. Further, driven roller 16, before postal matter M reaches nip N, rolls and touches drive roller 14 so that the driving force is transferred and is driven to rotate in the direction of the arrow shown in the drawing.

When postal matter M rushes into nip N, roller portion 16*b* is crushed and postal matter M is slowly clamped between roller portion 16*b* and roller portion 14*b* of drive roller 14. At this time, roller portion 16*b* is given force R in the perpendicular direction to postal matter M from the roller surface. Therefore, on postal matter M, reaction force Rsin θ for pressing back postal matter M in the opposite direction of the conveying direction (the direction of arrow T shown in the drawing) is acted. The reaction force Rsin θ increases as the thickness of postal matter M increases.

On the other hand, postal matter M is conveyed in the direction of arrow T by conveying force F based on the rotation of roller portion 14*b* and conveying force F' based on the rotation (driven rotation) of roller portion 16*b*. Therefore, when the resultant force of conveying forces F and F' acting on postal matter M is sufficiently larger than reaction force Rsin θ, postal matter M is normally conveyed, though when conveying forces F and F' are reduced, a transfer defect is caused.

Namely, when the coefficients of dynamic friction of roller portions 14*b* and 16*b* for postal matter M are low, conveying forces F and F' are reduced and the aforementioned effect of reaction force Rsin θ is increased. Therefore, to normally convey postal matter M, it is necessary to increase conveying forces F and F', that is, the coefficients of dynamic friction of roller portions 14*b* and 16*b* for postal matter M as large as possible.

Further, to obtain a normal conveying performance, a method for reducing the elasticity of roller portion 16*b* so as to reduce reaction force Rsin θ in addition to increase the coefficient of dynamic friction may be considered. Therefore, in this embodiment, the two-layer structure that roller portion 16*b* has internally sponge 42 is used. Further, the hardness and thickness of sponge 42 are requirements for obtaining a follow-up deformation performance to postal matter M and a proper pressure by a mutual action. When the hardness is too high or the thickness is too thin, follow-up deformation is difficult and defective conveying may be caused or postal matter M and drive roller 14 (peripheral members included) may be damaged. Namely, to normally process postal matter M by processing apparatus 10 mentioned above, it is necessary to set the coefficient of dynamic friction, hardness, and thickness of roller portion 16*b* to appropriate values.

Next, the operation of processing apparatus 10 having the aforementioned structure to process postal matter M non-uniform in the thickness will be explained particularly in consideration of the behavior of two rollers 14 and 16. Further, here, as shown in FIG. 5, a case that postal matter M whose non-uniform thickness on the side (the upper side in the drawing) clamped and conveyed by two roller portions 14*b* and 16*b* installed upward in the axial direction is thicker than the thickness on the side (the lower side in the drawing) clamped and conveyed by two roller portions 14*c* and 16*c* installed downward is to be conveyed will be explained.

As mentioned above, roller portions 16*b* and 16*c* of driven roller 16 are formed by an elastically deformable material and according to the thickness of postal matter M passing nip N between roller portions 14*b* and 14*c* of drive roller 14, the deformation amount thereof is changed. In this operation example, roller portion 16*b* for clamping and conveying the thick side of postal matter M is larger in the deformation amount than roller portion 16*c* for clamping and conveying the thin side thereof. In other words, in this case, the apparent radius of roller portion 16*b* is smaller than the apparent radius of roller portion 16*c*.

Therefore, as mentioned above, when postal matter M non-uniform in the thickness is sent in via conveying path 13 and passes nip N, the angular velocity of roller portion 16*b* with a smaller radius is larger than the angular velocity of roller portion 16*c* with a larger radius. Namely, the traveling speed of the outer peripheral surface of each of roller portions 16*b* and 16*c* rotating in contact with postal matter M is the same, so that the angular velocity of roller portion 16*b* with a smaller radius is larger. Although the angular velocities are different, the traveling speeds of the outer peripheries of roller portions 16*b* and 16*c*, that is, the peripheral speeds are the same.

Inversely, when roller portions 16*b* and 16*c* are fixed to rotation shaft 16*a*, the angular velocities of roller portions 16*b* and 16*c* become physically equal, so that the peripheral speeds of two roller portions 16*b* and 16*c* different in the radius become different from each other. When a difference appears in the peripheral speed between two roller portions 16*b* and 16*c* like this, a difference appears in the conveying speed of postal matter M, thus not only postal matter M gets wrinkled and skewed but also in the worst case, postal matter M is broken.

Therefore, in this embodiment, roller portions 16*b* and 16*c* are attached to rotation shaft 16*a* independently and rotatably. By doing this, roller portions 16*b* and 16*c* can be made different in the angular velocity and can respond to postal matter M non-uniform in the thickness.

Namely, according to this embodiment, two roller portions 16*b* and 16*c* installed on the same shaft of driven roller 16 can rotate independently of rotation shaft 16, so that even when clamping and conveying postal matter M non-uniform in the thickness, postal matter M does not get wrinkled and skewed, produces no faults such as breaking, and can be conveyed surely.

Further, the present invention is not limited straight to the aforementioned embodiments and at an execution stage, within a range that is not deviated from the object of the present invention, the components thereof can be modified and actualized. Further, by appropriate combination of a plurality of components disclosed in the aforementioned embodiments, various inventions can be formed. For example, from all the components disclosed in the aforementioned embodiments, some components may be deleted. Furthermore, components extending over different embodiments may be combined properly.

For example, in the aforementioned embodiments, the apparatus having two processing portions 2 and 4 installed on one side (on the lower side in the drawing) of main conveying path 1 is explained. However, the present invention is not limited to it and on the other side (on the upper side in the drawing) of main conveying path 1, two processing portions 2 and 4 can be additionally installed. Furthermore, on both sides of main conveying path 1, a plurality of sets of processing portions 2 and 4 may be installed side by side. In any case, it is desirable to arrange a switchback portion and a U-turn path in a nest state in neighboring two processing portions.

The sheets processing apparatus of the present inventions has the aforementioned constitution, so that when the first and second processing portions are installed side by side along the main conveying path, the size of the apparatus along the main conveying path can be reduced. Further, the curvatures of the first and second U-turn paths can be made larger comparatively and paper-like materials comparatively thick and hard can be processed.

What is claimed is:

1. A sheets processing apparatus comprising:

a main conveying path configured to convey first and second sheets to be processed;

a first processing portion having a first switchback portion and a first U-turn path, in which the first switchback portion is arranged upstream of the first U-turn path, the first switchback portion is configured to receive the first sheet branched and conveyed from the main conveying path, and send the first sheet out in an opposite direction, thereby reversing the conveying direction of the first sheet, and the first U-turn path is configured to reverse the front and back of the first sheet switched back its conveying direction by the first switchback portion;

a second processing portion having a second U-turn path and a second switchback portion, in which the second U-turn path is arranged upstream of the second switchback portion, the second U-turn path is configured to reverse the front and back of the second sheet branched and conveyed from the main conveying path therethrough, and the second switchback portion is configured to receive the second sheet after passing the second U-turn path, and send the second sheet out in an opposite direction, thereby reversing the conveying direction of the second sheet;

a conveying path to an exit configured to join and convey the first sheet from the first processing portion and the second sheet from the second processing portion together; and a non-reversing conveying path configured to join and convey the first sheet and the second sheet from the main conveying path onto the conveying path to the exit without separating to the first processing portion and the second processing portion and without reversing the first sheet and the second sheet, wherein the first switchback portion is arranged inside the second U-turn path and the second switchback portion is arranged inside the first U-turn path, and wherein the first switchback portion and the second switchback portion respectively comprising:

a plurality of drive rollers which rotate in the same direction and in the same peripheral speed in contact with the same side of one of the first and second sheets taken out on the conveying path, a plurality of independently rotatable driven rollers which are arranged in contact with the plurality of drive rollers so that they are able to rotate in accordance with the drive rollers, the driven rollers each having a two-layer structure comprised of an outer first layer formed by solid elastic body to be in contact with the drive roller that opposes the driven roller, and an inner second layer formed by a foamed elastic body, and receiving one of the first and second sheets into a nip formed between the opposing drive roller by being elastically deformed, the drive roller and the driven roller that opposes the drive roller are so arranged that the sheets conveyed to the switchback portion rushes into the nip from a direction tilting toward the driven roller and strikes against a roller portion of the drive roller, a rotation shaft for supporting the drive rollers separated axially away from each other, a stationary shaft for rotatably supporting the driven rollers separated axially away from each other, a frame for mounting the rotation shaft and the stationary shaft in a fixed position relationship with each other, wherein each of the first and second switchback portions clamps and conveys one of the first and second sheets conveyed into the nip, and wherein each of the first and the second switchback portions inversely rotates the plurality of drive rollers to send one of the first and second sheets in the inverse direction toward the nip.

2. The sheets processing apparatus according to claim 1, wherein the first U-turn path and the second U-turn path are arranged in a nest state.

3. The sheets processing apparatus according to claim 1, wherein the main conveying path includes a third U-turn path and the first switchback portion is arranged inside the third U-turn path.

4. A sheets processing apparatus comprising:

a main conveying path configured to convey first and second sheets to be processed;

a first processing portion configured to process the first sheet, in which an upstream end of the first processing portion is arranged to branch from the main conveying path and a downstream end of the first processing portion is arranged to join a conveying path to an exit; and a second processing portion configured to process the second sheet, in which an upstream end of the second processing portion is arranged to branch from the main conveying path and a downstream end of the second processing portion is arranged to join the conveying path to the exit;

wherein the first processing portion comprises a first switchback portion and a first U-turn path arranged downstream of the first switchback portion, the first switchback portion configured to switch the conveying direction of the first sheet in an opposite direction and the first U-turn path configured to reverse the front and back of the first sheet switched back its conveying direction by the first switchback portion, and the second processing portion comprises a second U-turn path and a second switchback portion arranged downstream of the second U-turn path, the second U-turn path configured to reverse the front and back of the second sheet branched from the main conveying path, and the second switchback portion configured to reverse the conveying direction of the second sheet in an opposite direction, wherein the first switchback portion is arranged inside the second U-turn path and the second switchback portion is arranged inside the first U-turn path, and wherein the first switchback portion and the second switchback portion respectively comprising:

a plurality of drive rollers which rotate in the same direction and in the same peripheral speed in contact with the same side of one of the first and second sheets taken out on the conveying path, a plurality of independently rotatable driven rollers which are arranged in contact with the plurality of drive rollers so that they are able to rotate in accordance with the drive rollers, the driven rollers each having a two-layer structure comprised of an outer first layer formed by solid elastic body to be in contact with the drive roller that opposes the driven roller and an inner second layer formed by a foamed elastic body, and receiving one of the first and second sheets into a nip formed between the opposing drive roller by being elastically deformed, the drive roller and the driven roller that opposes the drive roller are so arranged that the sheets conveyed to the switchback portion rushes into the nip from a direction tilting toward the driven roller and strikes against a roller portion of the drive roller, a rotation shaft for supporting the drive rollers separated axially away from each other, a stationary shaft for rotatably supporting the driven rollers separated axially away from each other, a frame for mounting the rotation shaft and the stationary shaft in a fixed position relationship with each other, wherein each of the first and second switchback portions clamps and conveys one of the first and second sheets conveyed into the nip, and wherein each of the first and the second switchback portions inversely rotates the plurality of drive rollers to send one of the first and second sheets in the inverse direction toward the nip.

* * * * *